US005822645A

United States Patent [19]

Piccinino, Jr. et al.

[11] Patent Number: 5,822,645

[45] Date of Patent: Oct. 13, 1998

[54] PHOTOGRAPHIC PROCESSOR

[75] Inventors: Ralph L. Piccinino, Jr., Rush; John H. Rosenburgh, Hilton, both of N.Y.

[73] Assignee: Eastman Kodak Company, Rochester, N.Y.

[21] Appl. No.: 839,331

[22] Filed: Apr. 17, 1997

[51] Int. Cl.[6] ..... G03D 3/92; G03D 3/08

[52] U.S. Cl. ..... 396/636; 396/622; 396/626; 396/645

[58] Field of Search ..... 396/617, 620, 396/622, 626, 627, 628, 630, 636, 642, 643, 645, 646

[56] References Cited

U.S. PATENT DOCUMENTS

| | | | |
|---|---|---|---|
| 3,688,677 | 9/1972 | Frick et al. | 396/626 |
| 4,477,165 | 10/1984 | Yoshikawa et al. . | |
| 4,490,030 | 12/1984 | Acklin | 396/622 |
| 4,577,949 | 3/1986 | Geyken et al. | 396/617 |
| 4,647,173 | 3/1987 | Schur | 396/617 |
| 5,239,327 | 8/1993 | Frank | 396/617 |
| 5,270,762 | 12/1993 | Rosenburgh et al. . | |
| 5,313,243 | 5/1994 | Rosenburgh et al. . | |
| 5,325,144 | 6/1994 | Yoshikawa et al. . | |
| 5,347,327 | 9/1994 | Sekine et al. . | |
| 5,353,087 | 10/1994 | Rosenburgh et al. . | |
| 5,353,088 | 10/1994 | Rosenburgh et al. . | |
| 5,355,190 | 10/1994 | Rosenburgh et al. . | |
| 5,381,203 | 1/1995 | Piccinino, Jr. et al. . | |
| 5,386,261 | 1/1995 | Patton et al. . | |
| 5,398,094 | 3/1995 | Rosenburgh et al. . | |
| 5,400,106 | 3/1995 | Rosenburgh et al. . | |
| 5,418,591 | 5/1995 | Rosenburgh et al. . | |
| 5,420,659 | 5/1995 | Manico et al. . | |

*Primary Examiner*—A. A. Mathews
*Attorney, Agent, or Firm*—Frank Pincelli

[57] ABSTRACT

An apparatus for processing a photosensitive material. The apparatus comprises a narrow processing channel for containing a processing solution for processing of a photographic material passing through the processing channel. A discharge nozzle is provided in the processing channel for dispensing of processing solution against the photographic material as it passes through the processing channel. A step is provided in the processing channel for lifting the leading edge of the photosensitive material from the bottom surface of the processing channel such that the photosensitive material will pass easily by the discharge nozzle.

22 Claims, 8 Drawing Sheets

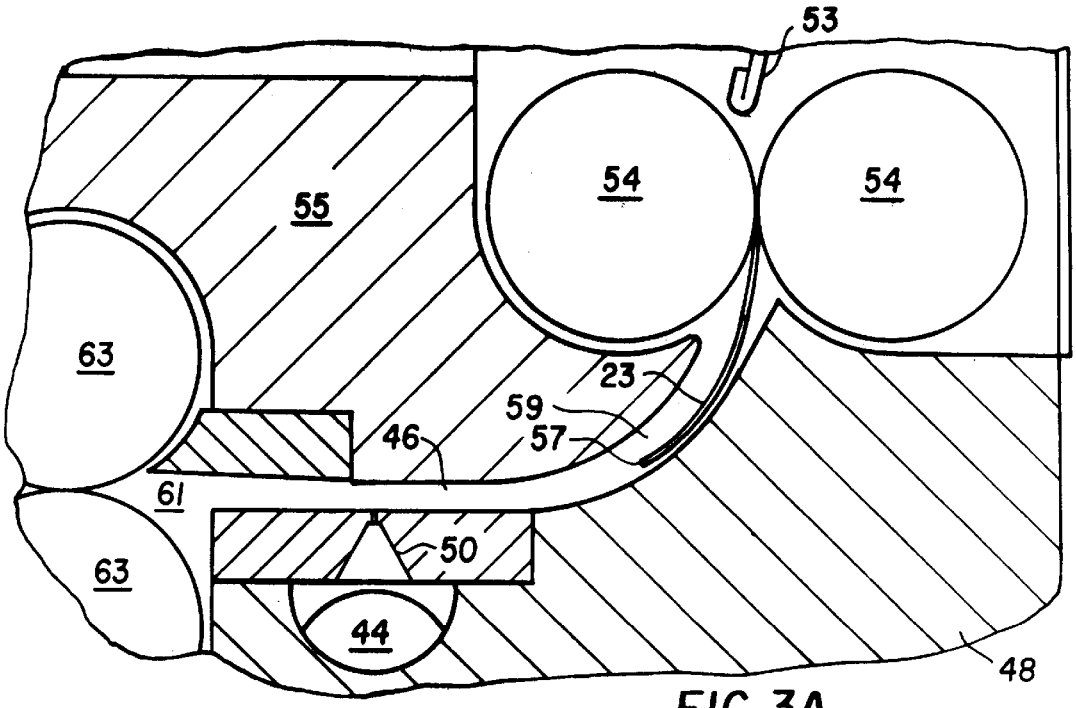
FIG. 3A
(prior art)
FIG. 3B
(prior art)
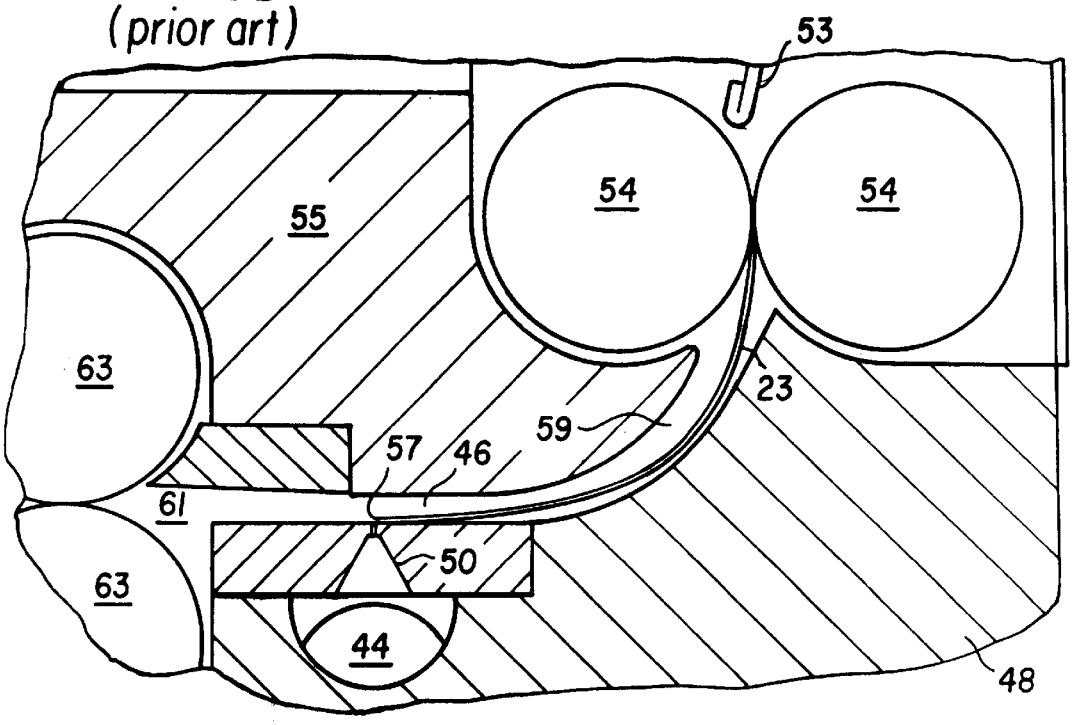

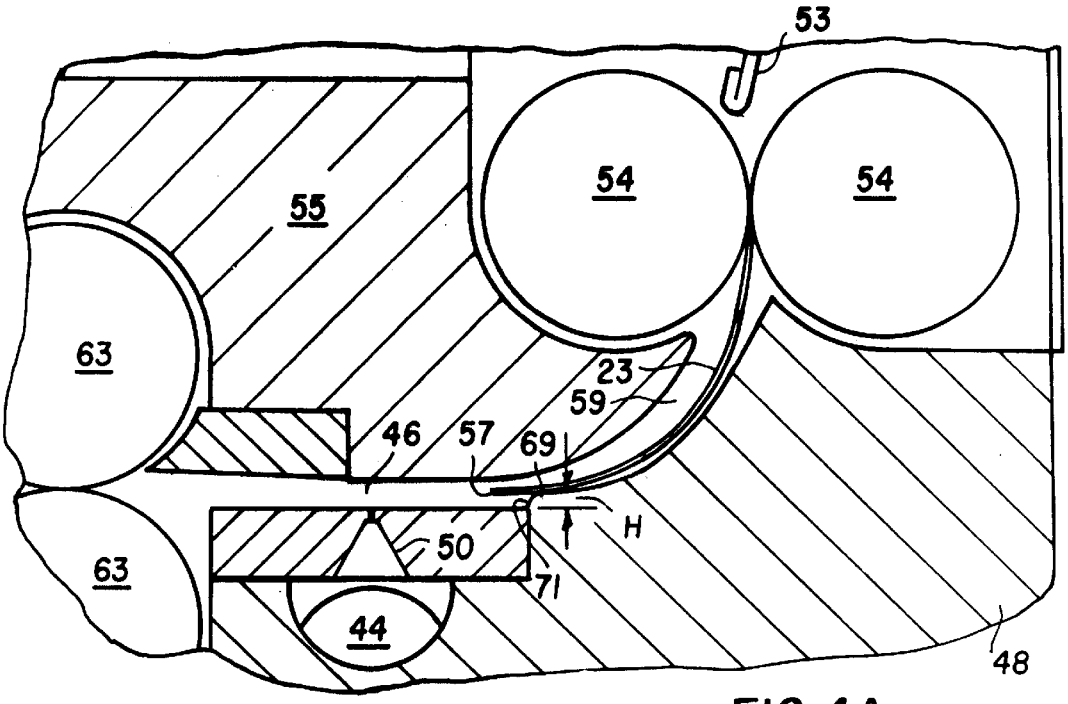
FIG. 4A
FIG. 4B
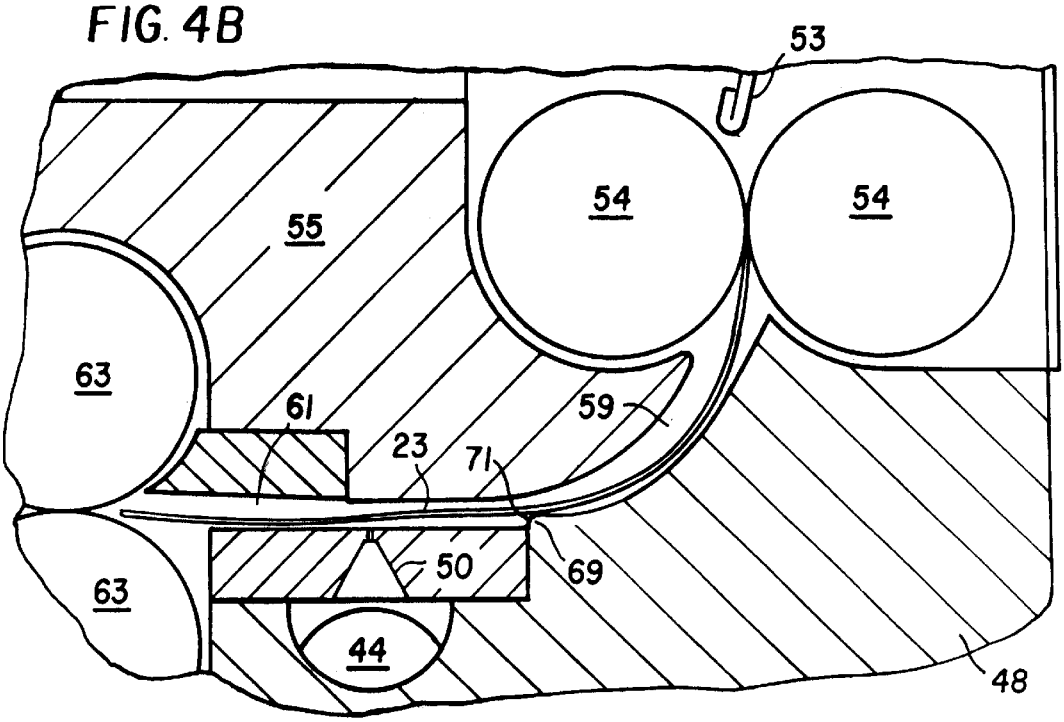

PHOTOGRAPHIC PROCESSOR

FIELD OF THE INVENTION

The present invention relates to the field of photographic processors and in particular to low volume thin tank type processors.

BACKGROUND OF THE INVENTION

U.S. Pat. Nos. 5,270,762; 5,353,088; 5,400,106; 5,420,659; 5,355,190; 5,398,094; 5,313,243; 5,418,591; 5,347,327; 5,386,261; 5,381,203; 5,353,087 illustrate thin tank processors wherein a photosensitive material is passed through a narrow processing channel. The processing channel has a generally U-shaped configuration comprising a first generally arcuate entrance section, a generally straight processing section, and a generally arcuate exit section. A nozzle is typically provided in the narrow processing channel for impinging a processing solution onto the photosensitive material as it passes through the processing channel. The processor is designed to process individual sheets and/or a continuous web.

While these type processors have provided efficient processing of photosensitive material while using a relatively small amount of processing solution, applicants have found that when a new web or sheet of photosensitive material enters into the processing channel, the leading edge of the photosensitive material is subject to damage or potentially jamming in the processing channel. In particular, the leading edge has a tendency to jam in the nozzle supplying the processing solution to the processing channel.

The present invention solves the foregoing problem by providing a step in the channel thereby minimizing or eliminating the problem of the photosensitive material jamming in the processing channel.

SUMMARY OF THE INVENTION

In accordance with the present invention there is provided an apparatus for processing a photosensitive material. The apparatus comprises a narrow processing channel for containing a processing solution for processing of a photographic material passing through the processing channel. A discharge nozzle is provided in the processing channel for dispensing of processing solution against the photographic material as it passes through the processing channel. The processing channel has a step for lifting the leading edge of the photosensitive material from the bottom surface of the processing channel such that the photosensitive material will pass easily by the discharge nozzle.

DESCRIPTION OF THE DRAWINGS

Other objects, advantages and features of the present invention will become apparent from the following specification when taken in conjunction with the drawings in which like elements are commonly enumerated and in which:

FIG. 3A is an enlarged partial cross-sectional view of a portion of a processing channel made in accordance with the prior art;

FIG. 3B is a view similar to FIG. 3A illustrating jamming of the leading edge of a photosensitive material in the nozzle of the processing channel;

FIG. 4A is an enlarged partial cross-sectional view of the processing channel of FIG. 2 illustrating the first nozzle for providing processing solution to the processing channel;

FIG. 4B is a view similar to FIG. 4A illustrating the leading edge of a photosensitive material passing by the nozzle in the processing channel;

DETAILED DESCRIPTION OF THE INVENTION

Figure 1:
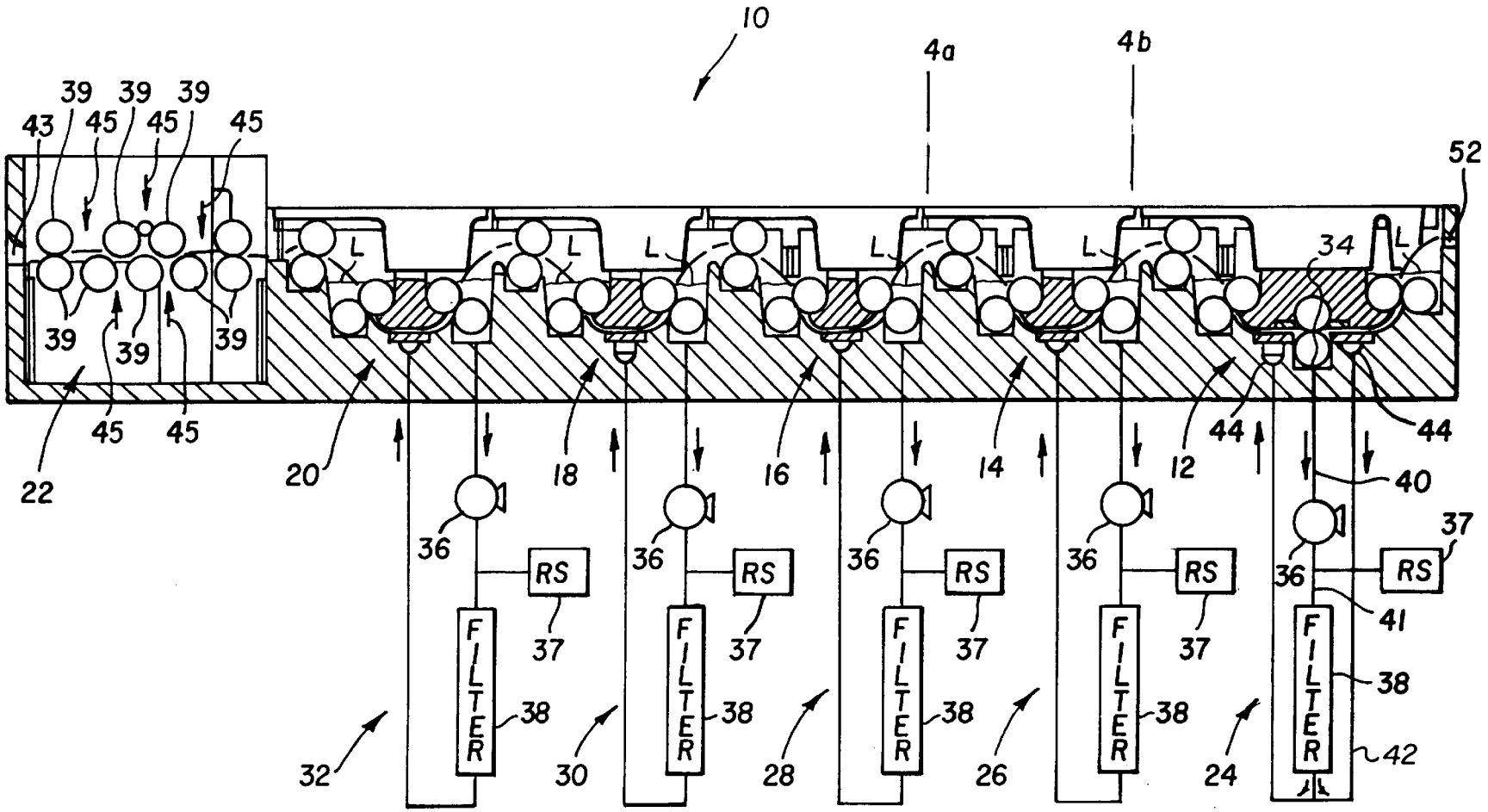
FIG. 1 illustrates a schematic view of a processing apparatus made in accordance with the present invention.

Referring to FIG. 1, there is illustrated a processing apparatus 10 made in accordance with the present invention. The apparatus includes a plurality of processing sections 12,14,16,18,20, each processing section being designed to hold a processing solution 21 for processing a photosensitive material 23 (see FIG. 2) passing therethrough. In the particular embodiment illustrated, processing section 12 contains a developing processing solution; section 14 contains a bleach-fixing processing solution; and sections 16,18,20 each contain a stabilizer wash processing solution. The level of the processing solution for each of the processing sections is indicated by the letter L. A dryer 22 is provided for drying of the photosensitive material 23 after it has exited the last processing section 20.

The dryer 22 includes a plurality of rollers 39 for guiding and transporting of the photosensitive material 23 through the dryer 22. An appropriate mechanism, as is well known in the art, is provided for providing drying air against the photosensitive material 23, as indicated by arrows 45 as it passes through the dryer 22 such that the photosensitive material is substantially dry as it exits the apparatus 10 through exit opening 43.

Recirculation systems 24,26,28,30,32 are provided for recirculating processing solution through each of the processing sections 12,14,16,18,20, respectively. Each of the recirculation systems 24,26,28,30,32 are substantially identical in construction, like numerals indicating like parts and operation. Therefore, only recirculation system 24 will be discussed in detail, it being understood that the remaining recirculation systems are substantially identical in construction and operation.

The recirculation system 24 obtains processing solution from outlet 34 which is fluidly connected to pump 36 by conduit 40. Processing solution is recirculated by pump 36 through a filter 38 through conduit 41. The processing solution leaves filter 38 through conduit 42 and is supplied to the inlet 44 of the processing section 12. A replenishment system 37 is provided in recirculation system 24 for introducing replenishment solution into the recirculation system 24 as is commonly done in such processors for replenishment of the recirculating processing solution.

Figure 2:
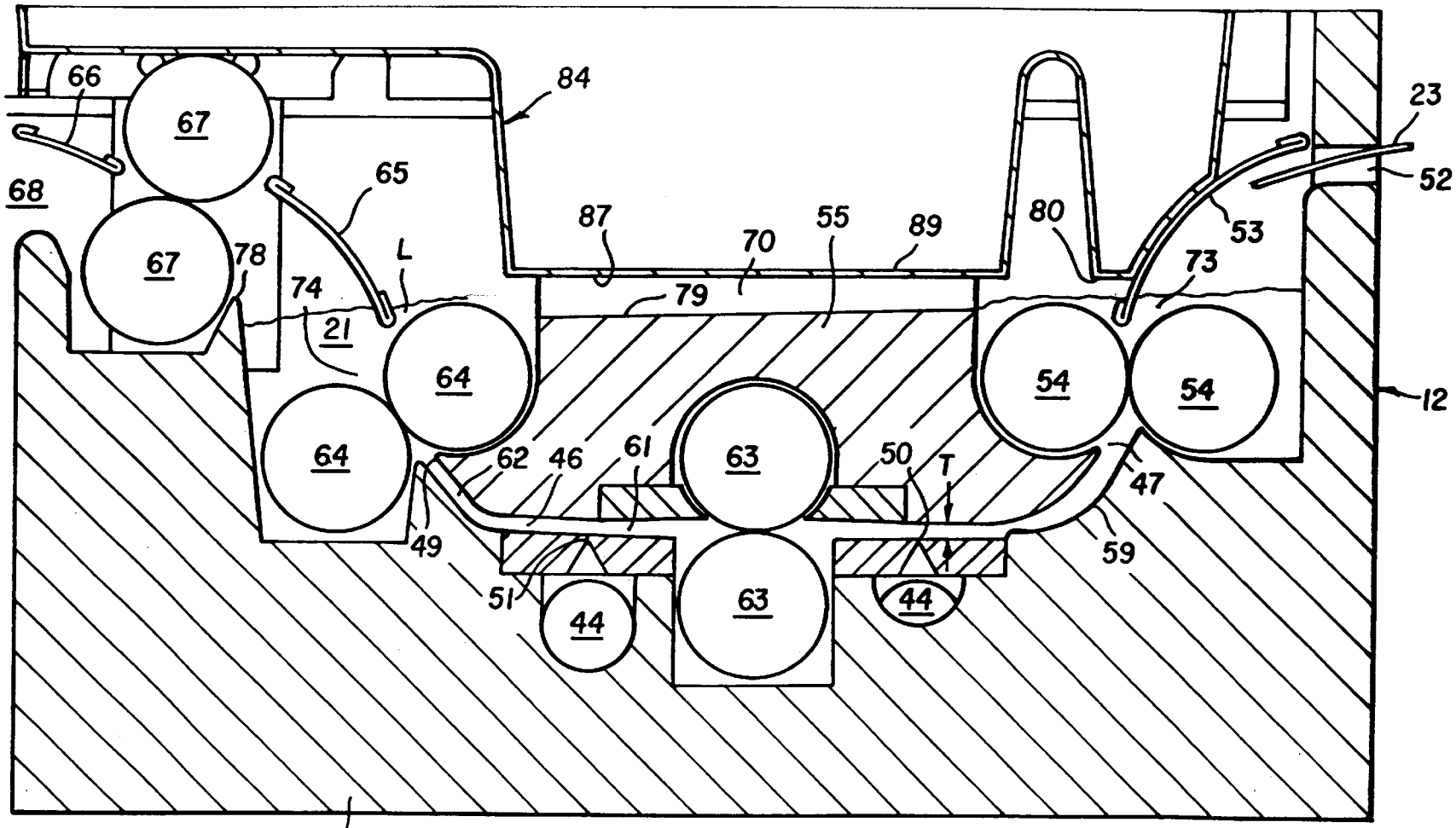
FIG. 2 is an enlarged cross-sectional view of the developing section of the processing apparatus of FIG. 1 illustrating the processing channel for processing of a photosensitive material passing through the processing channel.

Referring to FIG. 2, there is illustrated in greater detail the processing section 12. The processing section 12 is designed to be of the low volume thin tank type. In particular, a narrow processing channel 46 having an inlet 47 and outlet 49 is provided through which the photosensitive material 23 passes for processing. The processing channel 46 has a substantially constant thickness T along its length. The processing channel 46, for a processor for processing photographic paper, preferably has a thickness T equal to or less than 50 times the paper thickness, preferably a thickness T equal to or less than about 10 times the thickness of the photographic paper. In a processor for processing photographic film, the thickness T should be equal to or less than about 100 times the thickness of the film, preferably equal to or less than about 18 times the thickness of the film.

The processing section 12, as previously discussed, is of the low volume type, that is, the total amount of processed solution contained in the processing section 12 accounts for at least 40% of the total volume of the processing solution available, that is, the processing solution available in the processing section 12 and the recirculation system 24. Preferably, the volume of the processing solution in processing section 12 is at least 50% of the total volume of available processing solution. In the particular embodiment illustrated, the volume of the processing solution in the processing section 12 is approximately 60% of the total volume of processing solution available. The processing section 12 is designed such that there is very little excess area or volume in which the processing solution 21 may reside outside of the processing channel 46. Where possible, the appropriate parts are configured to closely conform to any rollers or other items placed therein.

In the embodiment illustrated, processing section 12 includes a pair of nozzles 50,51 for introducing processing solution 21 from inlet 44 into the processing channel 46 against the side of the photosensitive material 23 having the photosensitive emulsion. The processing solution 21 is introduced so as to impinge against the photosensitive material 23, preferably with a sufficient degree of force so as introduce fresh processing solution to the surface of the photosensitive material 23. In particular, each of the processing nozzles 50,51 comprise an elongated narrow continuous slot which extends across the width of the processing material passing through the processing channel 46.

In order to provide efficient flow of processing solution through the nozzles 50,51 it is desirable for each of the nozzles 50,51 deliver processing solution to the processing channel 46 in accordance with the following relationship:

$$1 \leqq F/A \leqq 40$$

wherein:

F is the flow rate of the solution through the nozzle in gallons per minute; and A is the cross-sectional area of the nozzle provided in square inches.

Providing slot nozzles in accordance with the foregoing relationship assures appropriate discharge of processed solution against the photosensitive material.

Photosensitive material 23 enters the processing section 12 through opening 52 and is guided by guide plate 53 to a pair of entrance rollers 54.

As can be seen, the processing channel 46 has a generally U-shaped overall configuration wherein photosensitive material enters a first generally arcuate section 59 through inlet 47 and then passed through a generally straight section 61 where the nozzles 50,51 are located, and then through a generally arcuate exit section 62 wherein the photosensitive material 23 passes out of the outlet 49 of the processing channel 46. In the embodiment illustrated, the straight section 61 extends in a substantially horizontal direction. When the photosensitive material travels in a horizontal direction, the force of gravity contributes to the potential jamming of the photosensitive material.

A second, third and fourth pair of guide/transport rollers 63,64,67 are provided for guiding and/or transporting of the photosensitive material 23. In particular, the pair of rollers 63 guide the photosensitive material 23 in the straight section 61 of the processing channel 46, and rollers 64 guide the photosensitive material 23 as it passes outlet 49 of the processing channel 46. A guide plate 66 is provided for guiding of the photosensitive material 23 out of outlet 68 of the processing section 12 onto the next processing section, which in the present embodiment is processing section 14.

As illustrated by FIG. 2, the processing channel 46 is formed by lower block assembly 48 and upper block member 55, the nozzles 50,51 being incorporated into the lower block assembly 48. It is to be understood that the nozzles 50,51 may be incorporated in the upper block member 55, or both the upper block member and lower block assembly as desired. As previously discussed, the processing section 12 is designed to hold a minimal amount of processing solution 21. The shape of the block members 48,55 are such that an entrance fluid retention area 73 is provided adjacent the inlet 47 of the processing channel 46 and a fluid retention area 74 is formed adjacent the outlet 49 of processing channel 46. A weir 78 is provided for allowing excess processing solution to pass out the processing section 12. In particular, the weir 78 is disposed for direct fluid communication with fluid retention area 74.

As illustrated in FIG. 2, a cover 84 is provided with a surface 87 which is designed to engage the upper surface 89 of the block member 48 and the adjacent processing solution 21 when it rises to the level of the cover 84. The cover 84 assists in minimizing oxidation of the processing solution 21 and protects the processing solution form external contamination.

Referring to FIG. 3A, there is illustrated a greatly enlarged view of a portion of the processing channel 46 of an apparatus made in accordance with the prior art, like numerals indicating like parts and operation, as previously discussed. In particular, there is illustrated the leading edge 57 of photosensitive material 23 as it leaves the arcuate section 59 and enters straight section 61. Referring to FIG. 3B, there is illustrated a view similar to FIG. 3A showing how the photosensitive material jams in the channel 46. As illustrated in FIG. 3B, the leading edge 57 gets caught in the first slot nozzle 50. It is believed that certain factors tend to keep the leading edge 57 pressed against the bottom wall of the channel 46. Thus, as the photosensitive material 23 is driven to the nozzle 50, the leading edge will jam into the nozzle as illustrated in FIG. 3B. Some of the numerous factors that can contribute to jamming of the photosensitive material are, for example, the shape of the leading edge 57, that is, is it jagged, bent, irregular, straight, de-laminated; the thickness of the channel; the thickness of the photosensitive material; the rigidity of the photosensitive material; the flow rate or flow profile of the processing solution from the nozzle; the orientation and direction of travel of the photosensitive material; and the shape of the arcuate section and distance the arcuate section is from the nozzle.

Referring to FIGS. 4A and 4B, there is illustrated enlarged views of a portion of the processing channel 46 made in accordance with the present invention, like numerals indicating like parts and operation as previously discussed. FIG. 4A illustrates the processing channel prior to receiving a photosensitive material 23 and FIG. 4B illustrates the photosensitive material 23 as it passes by the nozzles 50,51. At the transition point 71 between arcuate section 59 and straight section 61 there is provided a small step 69 having a height H. The height H of step 69 is not too large as to substantially interfere with the thickness of the processing channel, but is sufficiently large so as to lift the leading edge 57 of the photosensitive material so that processing solution will be able to get below the leading edge 57 such that the leading edge 57 will be lifted away from the nozzles 50,51 as it passes by. The specific height H of the step 69 will depend upon a variety of factors, for example, the stiffness of the photosensitive material 23, the presence and shape of the arcuate section 59, the distance the nozzle 50 is from the arcuate section 59 and straight section 61, the condition of the leading edge 57 of the photosensitive material, and the velocity and amount of processing solution that is provided. In the embodiment illustrated the height H is about 1.27 mm (0.05 inches), the thickness T of channel is about 2.5 mm (0.1 inches) and the length L is about 15.87 mm (0.625 inches).

Figure 5:
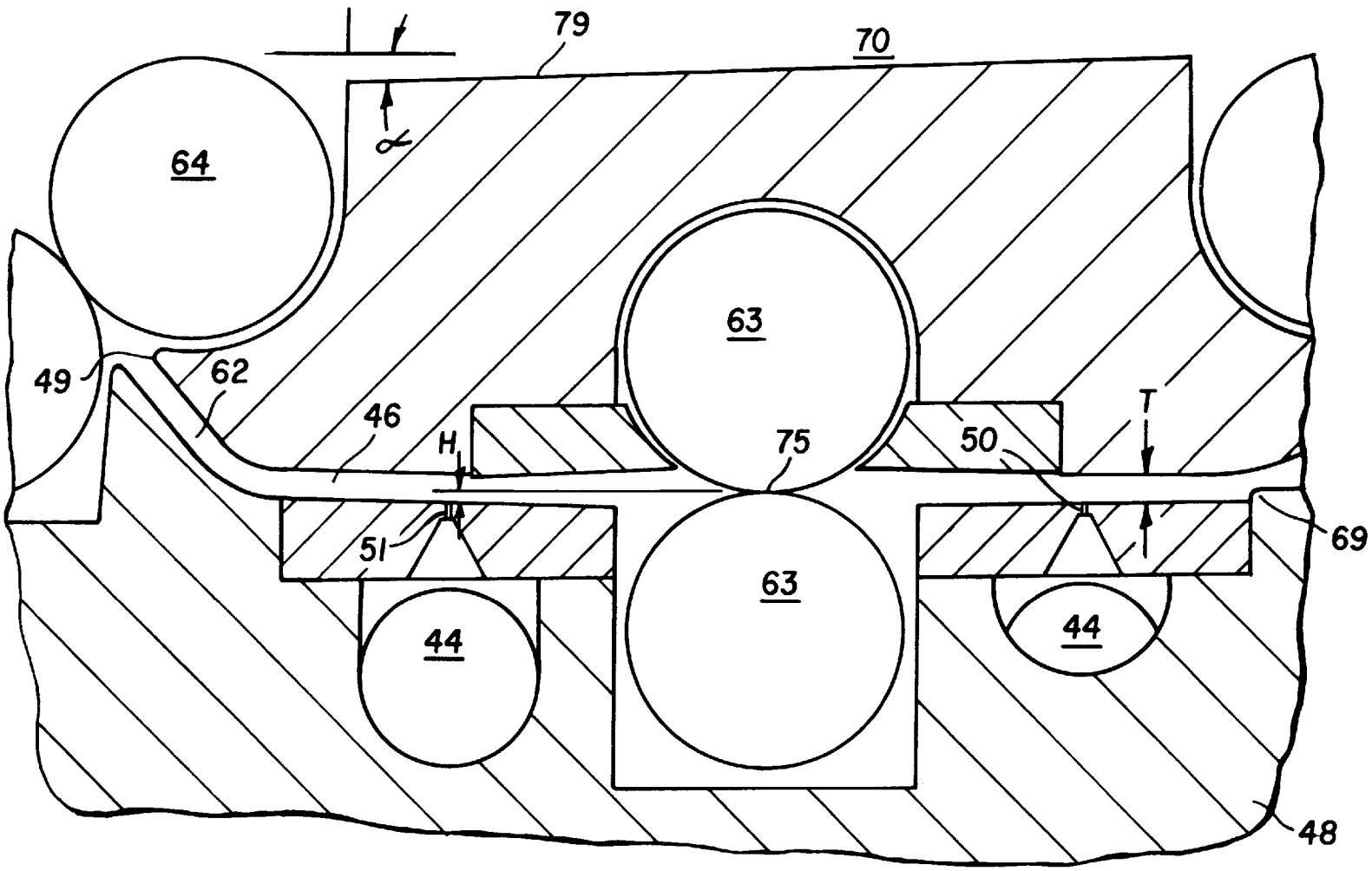
FIG. 5 is an enlarged partial cross-sectional view of the processing channel of FIG. 2 illustrating both nozzles provided in the processing channel.
Figure 9:
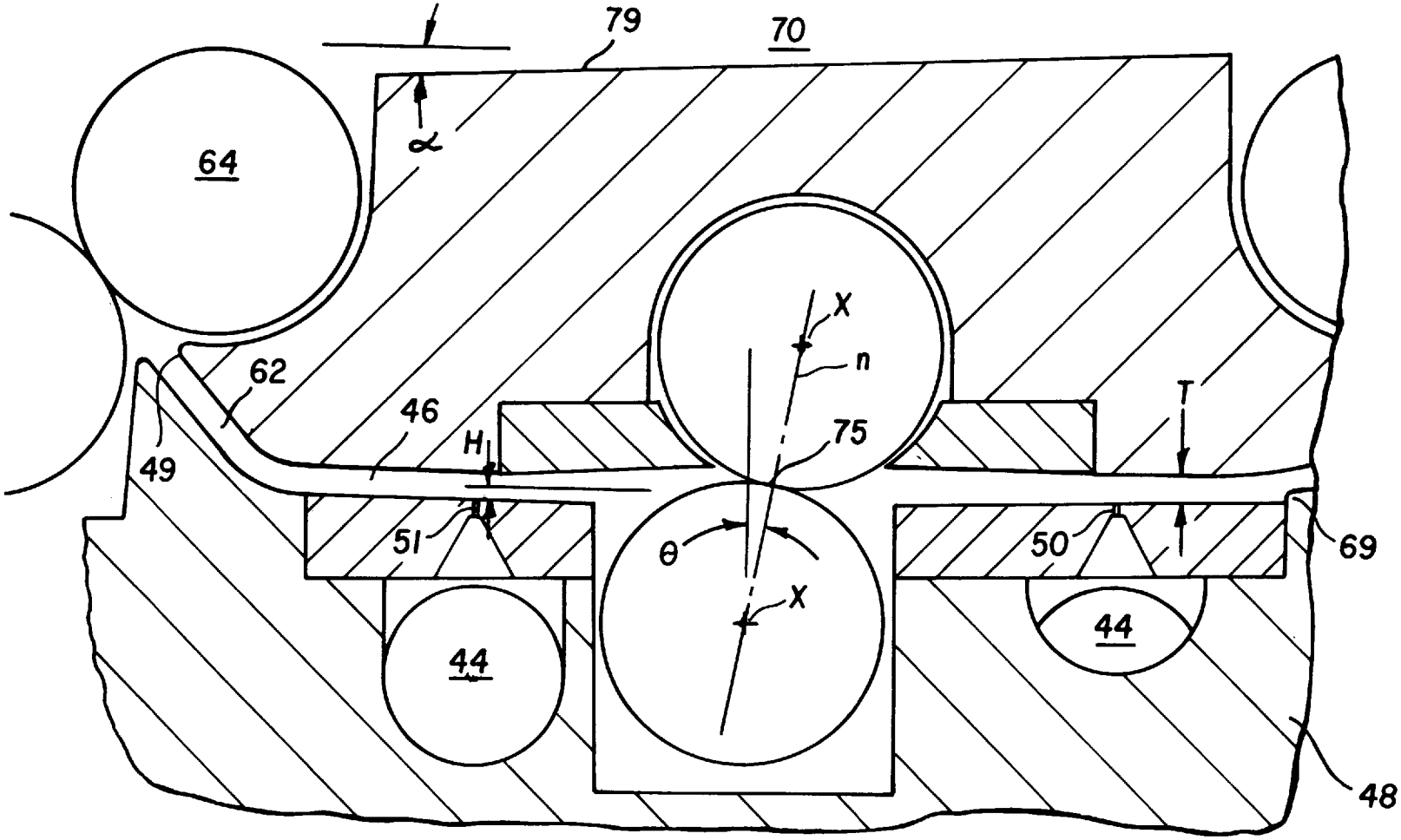
FIG. 9 is a schematic representation of the center rollers of the processing section of FIG. 4A disposed at an angle.

In the particular embodiment illustrated, processing section 12 includes a pair of nozzles 50,51 which are spaced apart a predetermined distance D1. If this distance is large, a second step may be required to avoid jamming in this second nozzle. Referring to FIG. 5, there is illustrated and enlarged partial view of the processing channel illustrating both nozzles 50,51. In the embodiment illustrated, a second step is provided by the pair of rollers 63. In particular, the nip 75 of rollers 63 is disposed a distance H above the nozzle 51. The nip 75 is disposed a distance from nozzle 51 in the same manner as step 69 is from nozzle 50. In place of and in combination with the nip being position above the nozzle, the rollers may be inclined such that a line 77 passing through the axis of rotation X of both rollers is inclined at an angle θ with respect to a line perpendicular to the direction of travel of the photosensitive material 23 (see FIG. 9) so that the photosensitive material passing therethrough is directed upwards away from the nozzle 51. Angle θ may be any angle appropriate to obtain the desired result.

Figure 6:
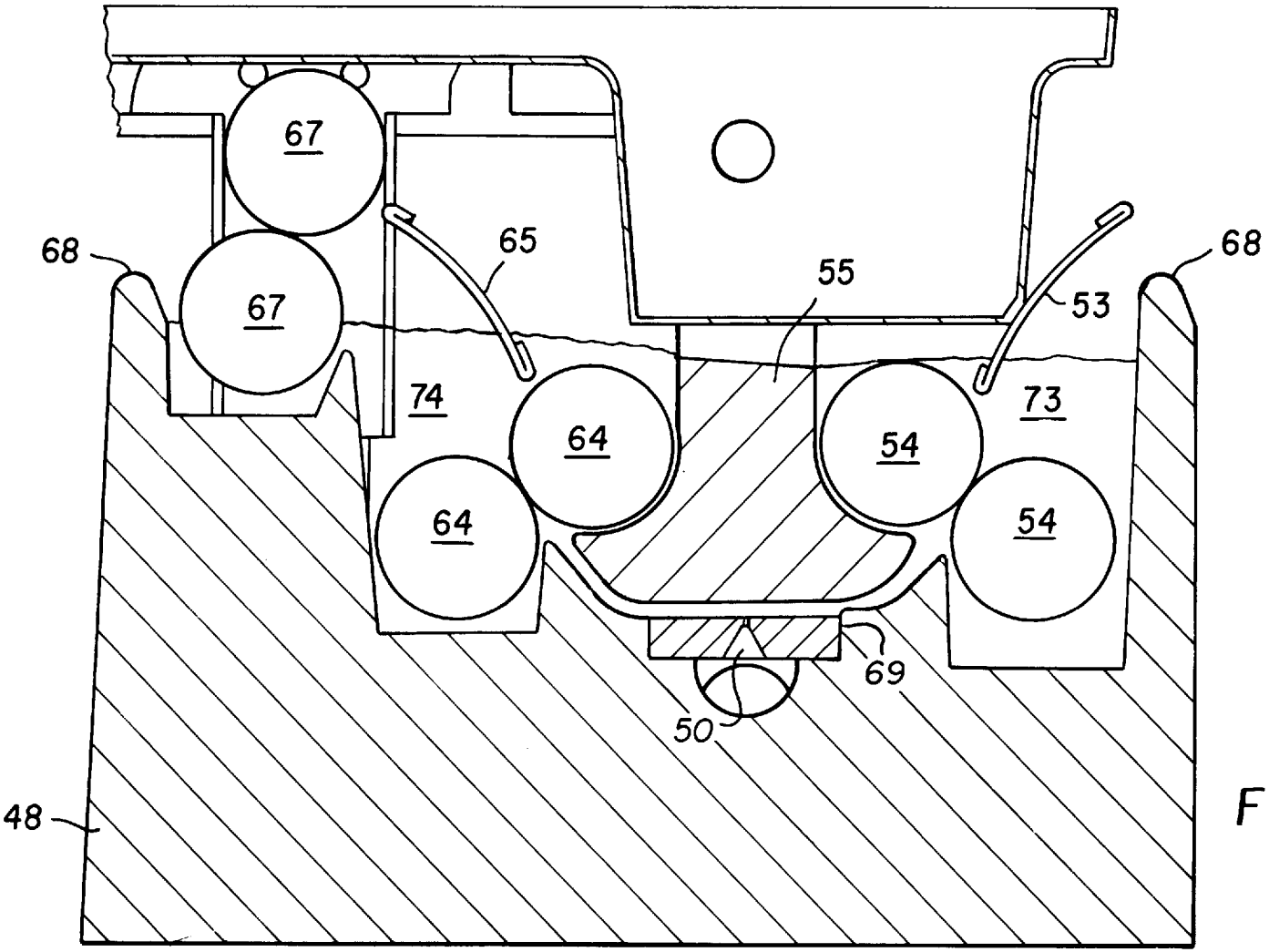
FIG. 6 is an enlarged cross-sectional view of a second processing section of the processing apparatus of FIG. 1 illustrating the processing channel for processing of a photosensitive material passing through the processing channel.

As previously discussed, the processing section 12 includes two nozzles. However, the present invention is equally applicable to other situations having any desired number of nozzles. Referring to FIG. 6, there is illustrated a cross-sectional view of processing section 14. Processing section 14 is similar to processing section 12, like numerals indicating like parts and operation. However, in this embodiment instead of providing a pair of nozzles 50,51 only a single nozzle 50 is provided.

The height H of the step 69 is preferably made in accordance with the following relationship:

$$L \operatorname{Tan} \phi \geq H$$

wherein:

H is the height of the step 69;

L is the distance from the step to the end of the nozzle;

θ is the angle formed by a straight line which starts just past the furthest end of the nozzle and is tangent to the corner of the step.

Figure 7:
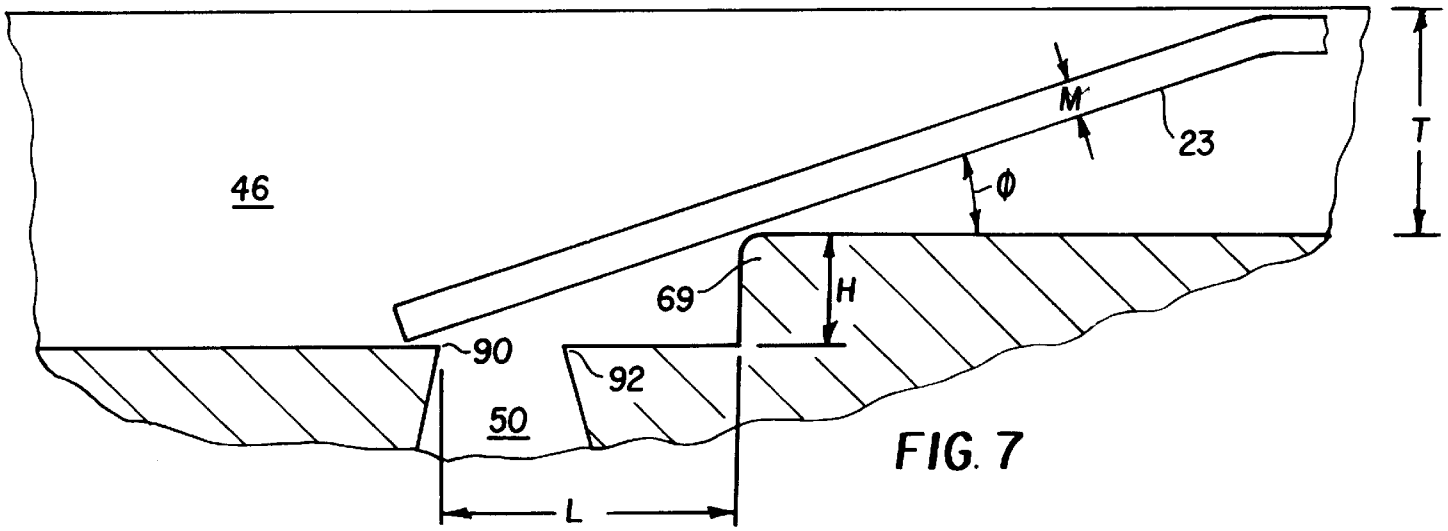
FIG. 7 is an enlarged schematic illustration of the slot nozzle illustrated in FIG. 4A.

Referring to FIG. 7, there is illustrated a schematic illustration as to how angle ϕ is determined. T is the thickness of the processing channel and M is the thickness of the photosensitive material 23.

Figure 8:
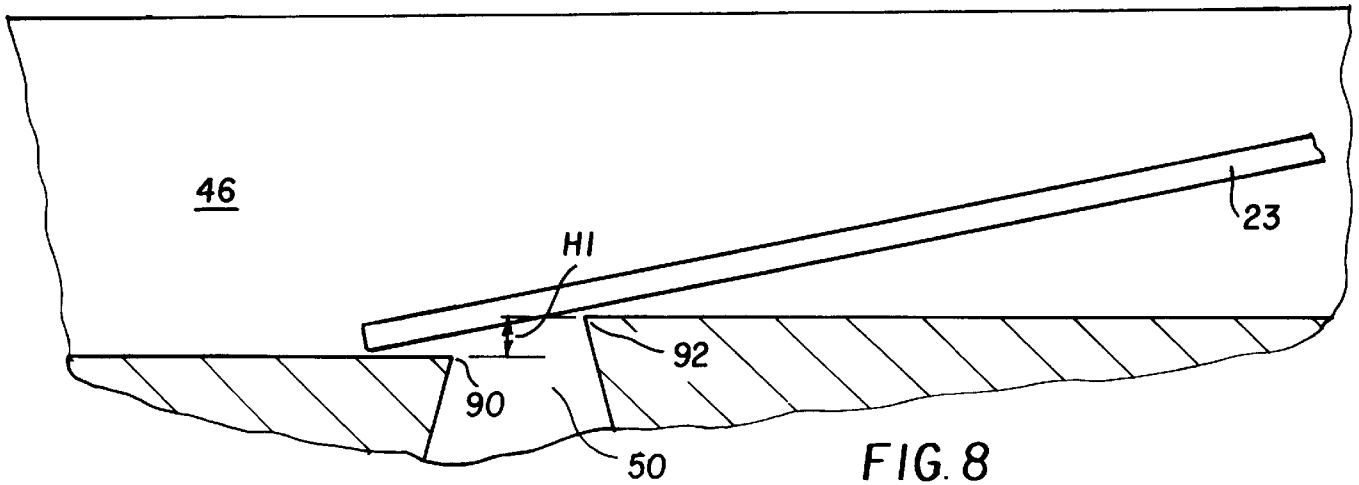
FIG. 8 is an enlarged schematic view similar to FIG. 7 illustrating a modified slot nozzle made in accordance with the present invention.

Referring to FIG. 8, there is illustrated in schematic form a modified processing channel 46 made in accordance with the present invention. In this embodiment trailing edge 90 of the nozzle 50 is disposed a distance H1 below the leading edge 92 so as to from a step directly at the first encountered nozzle 50. The height H1 is made in accordance with the same criteria as the height H for step 69. In this embodiment the step is made directly at the nozzle.

The photosensitive material 23 as it encounters the step 69 is caused to be lifted upwards a sufficient distance such that processing solution coming from the nozzle will get under the leading edge 67 so that it will minimize or prevent the leading edge 92 of the photosensitive material from being damaged or jamming into the nozzle by maintaining the leading edge 67 above the trailing edge 90 of the nozzle which introduces processing solution in to the processing channel.

After the photosensitive material 23 has passed through each of the processing channels of the processing module 20, it passes into dryer section 22. Rollers 82 are used to drive the photosensitive material 23 through outlet 86. Arrows 88 indicate flow of heated air which are used to dry the photosensitive material such that it is sufficiently dry as it leaves the processor 10.

In the particular embodiment illustrated, the processing section comprises an upper and lower block member that form the narrow processing channel. The present invention is also applicable to processors of other type constructions. For example, but not by way of limitation, the present invention may be used in rack and tank type processors such as shown and described in U.S. Pat. Nos. 5,508,776; 5,452,043; 5,432,581; 5,387,499; 5,418,591; and 5,420,658, which are incorporated by reference herein.

Thus, the present invention provides a processor which uses thin channel processing technology and slot nozzles for introducing processing solution into the processing channel which minimizes the possibility of damaging and/or jamming of the photosensitive material in the processing channel.

It is to be understood that various other changes and modifications may be made without departing from the scope of the present invention, the present invention being limited by the following claims.

Parts List

10 apparatus
12,14,16,18,20 processing sections
21 processing solution
22 dryer
23 photosensitive material
24, 26,28,30,32 recirculation systems
34 outlet
36 pump
37 replenishment system
38 filter
39 rollers
40,41,42 conduit
43 exit opening
44 inlet
45 arrows
46 processing channel
47 inlet
48 lower block member
49 outlet
50,51 nozzles
53 guide plate
54 entrance rollers
55 upper block member
57 leading edge
59 arcuate section

61 straight section
62 exit section
63,64,67 guide/transport rollers
66 guide plate
67 leading edge
68 outlet
69 step
71 transition point
73,74 fluid retention area
75 nip
77 line
78 weir
82 rollers
84 cover
86 outlet
87 surface
88 arrows
89 upper surface
90 trailing edge
92 leading edge

What is claimed is:

1. An apparatus for processing a photosensitive material, the apparatus comprising:

a narrow processing channel for containing a processing solution for processing of a photosensitive material passing through the processing channel, said processing channel having an inlet and an outlet;

a discharge nozzle provided in said processing channel for dispensing of processing solution against said photosensitive material as it passes through said processing channel, said processing channel having a bottom surface and a step for lifting a leading edge of the photosensitive material from the bottom surface of the processing channel such that the photosensitive material will pass easily by said discharge nozzle.

2. An apparatus according to claim 1 wherein said photosensitive material comprises photographic paper, said processing channel having a thickness T is equal to or less than 50 times the thickness of the photographic paper.

3. An apparatus according to claim 1 wherein said photosensitive material comprises photographic paper, said processing channel having a thickness T equal to or less than 10 times the thickness of the photographic paper.

4. An apparatus according to claim 1 wherein said photosensitive material comprises photographic film, said processing channel having a thickness T equal to or less than 100 times the thickness of the photographic film.

5. An apparatus according to claim 1 wherein said photosensitive material comprises photographic film, said processing channel having a thickness T equal to or less than 18 times the thickness of the photographic film.

6. An apparatus according to claim 1 wherein the step has a height H determined in accordance with the following relationship:

$$L \tan \phi \geqq H$$

wherein L is a distance from the step to an end of the nozzle; and $\phi$ is an angle formed by a straight line which starts just past a furthest end of the nozzle and is tangent to a corner of the step.

7. An apparatus according to claim 6 wherein the height H is about 1.27 mm.

8. An apparatus according to claim 1 wherein the step is located prior to the nozzle.

9. An apparatus according to claim 1 wherein the step is formed at the nozzle, said nozzle having a leading edge and a trailing edge, the trailing edge being positioned below the leading edge.

10. An apparatus according to claim 1 wherein the processing channel extends in a substantially horizontal direction.

11. An apparatus according to claim 1, wherein said processing channel comprises at least an arcuate section and a straight section, said step being provided at a transition point between the arcuate section and the straight section.

12. An apparatus for processing a photosensitive material, the apparatus comprising:

a processing channel for containing a processing solution for processing of the photosensitive material, said processing channel having an inlet section, a central section and an outlet section, said inlet and outlet sections extending in a generally arcuate path and said central section having a substantially straight path; and said central section having a discharge nozzle for dispensing of processing solution against said photosensitive material passing through said processing channel, said processing channel having a bottom surface and a step for lifting a leading edge of the photosensitive material from the bottom surface of the processing channel such that the photosensitive material will pass easily by said discharge nozzle.

13. An apparatus according to claim 12 wherein said photosensitive material comprises photographic paper, said processing channel having a thickness T equal to or less than 50 times the thickness of the photographic paper.

14. An apparatus according to claim 12 wherein said photosensitive material comprises photographic paper, said processing channel having a thickness T equal to or less than 10 times the thickness of the photographic paper.

15. An apparatus according to claim 12 wherein said photosensitive material comprises photographic film, said processing channel having a thickness T equal to or less than 100 times the thickness of the photographic film.

16. An apparatus according to claim 12 wherein said photosensitive material comprises photographic film, said processing channel having a thickness T equal to or less than 18 times the thickness of the photographic film.

17. An apparatus according to claim 12 wherein the step has a height H determined in accordance with the following relationship:

$$L \tan \phi \geqq H$$

wherein L is a distance from the step to an end of the nozzle; and $\phi$ is an angle formed by a straight line which starts just past a furthest end of the nozzle and is tangent to a corner of the step.

18. An apparatus according to claim 17 wherein the height H is about 1.27 mm.

19. An apparatus according to claim 12 wherein the step is located prior to the nozzle.

20. An apparatus according to claim 12 wherein the step is formed at the nozzle, said nozzle having a leading edge and a trailing edge, the trailing edge being positioned below the leading edge.

21. An apparatus according to claim 12 wherein the processing channel extends in a substantially horizontal direction.

22. An apparatus according to claim 12, wherein said step is provided at a transition point between said inlet section and said central section.

* * * * *